United States Patent [19]

Weischedel

[11] 4,219,804

[45] Aug. 26, 1980

[54] SENSOR FOR ELECTROMAGNETIC WAVES CAUSED BY NUCLEAR DETONATION

[75] Inventor: Richard C. Weischedel, Camillus, N.Y.

[73] Assignee: General Electric Company, Syracuse, N.Y.

[21] Appl. No.: 660,148

[22] Filed: Jul. 17, 1967

[51] Int. Cl.[2] ..... G08B 17/12

[52] U.S. Cl. ..... 340/600; 250/336; 250/338; 340/540; 340/601

[58] Field of Search ..... 250/83, 83.3, 336, 338; 340/214, 600, 601, 540

[56] References Cited

U.S. PATENT DOCUMENTS

| | | | |
|---|---|---|---|
| 3,147,380 | 9/1964 | Buckingham et al. | 250/83.3 |
| 3,254,219 | 5/1966 | Finlay et al. | 250/338 |
| 3,281,811 | 10/1966 | Cotterman et al. | 340/600 |
| 3,467,826 | 9/1969 | Cotterman | 250/336 |

*Primary Examiner*—S. C. Buczinski

*Attorney, Agent, or Firm*—Carl W. Baker

[57] ABSTRACT

An electronic sensor is disclosed, having circuits for identifying electromagnetic radiation signals caused by nuclear detonations. Circuits also are provided for discriminating against false indications due to electromagnetic radiation caused by lightning.

7 Claims, 4 Drawing Figures

+
11
AMPLITUDE
0
12
16
TIME
46'
23'
13
−
14

17
19
FEEDBACK
AMP.
18
21
22
HIGH-PASS FILTER
23
THRESHOLD DETECTOR T2
SET LINE
25
26
ZERO CROSSOVER DISCRIMINATOR
27
RISE TIME DISCRIMINATOR
28
PRECURSOR DISCRIMINATOR
31
AND
OUTPUT

SENSOR FOR ELECTROMAGNETIC WAVES CAUSED BY NUCLEAR DETONATION

BACKGROUND OF THE INVENTION

There is a need for apparatus to reliably detect nuclear detonations occurring within a range that will cause danger from "fallout" radioactive particles. For example, if a nuclear detonation occurs at a distance of approximately 10 to 100 miles, there may not be great danger from direct blast radiation, but the radioactive fallout particles will, usually in a matter of minutes or hours, be a serious threat to life and also to food and certain equipment such as radio, radar, power stations, military equipment, medical supplies, etc. Suitable detection or sensor apparatus will sound an alarm so that suitable and timely precautions can be taken to safeguard the lives of humans and animals (by the use of fallout shelters, for example) and to protect food, equipment, etc. A complete nuclear detonation sensor system may comprise a radiation sensor (for electromagnetic radiation, optical radiation, or both) and a seismic sensor for detecting the subsequent earth tremor.

It is important that the sensor system be reliable, both as to indicating all nuclear detonations within its range, and also as to not causing false indications. False indications may cause unnecessary expenses and perhaps public panic, and also will adversely affect credibility of the alarm system so as to impair its effectiveness in the event of a valid indication of nuclear detonation.

The electromagnetic sensors in such systems have been prone to be responsive to electromagnetic energy associated with lightning, thus giving false indications of nuclear detonations. This problem has not been readily solved, because of the similarity of electromagnetic waveshapes produced from nuclear detonations and from lightning strokes.

SUMMARY OF THE INVENTION

Objects of the invention are to provide an improved sensor for detecting electromagnetic signals caused by nuclear detonation, and to solve the prior-art problems described above.

The improved electromagnetic sensor of the invention comprises, briefly and in a preferred embodiment, circuitry for processing detected electromagnetic signals, this circuitry including a threshold detector adapted to detect whether an incoming signal exceeds a preset threshold level, and, when this occurs, to activate or enable three circuits: (1.) a rise time discriminator which determines whether the incoming signal reaches its peak value within a time such that it could be a valid nuclear detonation electromagnetic signal; (2.) a zero crossover discriminator which determines whether the incoming signal, after reaching its peak value, crosses the zero axis within a time such that it could be a valid nuclear detonation electromagnetic signal; and (3.) a precursor discriminator which determines whether the incoming signal is from a lightning stroke (the term "precursor" as used herein refers to a precursive low energy electrical discharge that occurs shortly prior to the main lightning stroke). The outputs of these three discriminators are applied to a circuit, such as an "AND" gate, which produces an output signal indicative of a nuclear detonation, only in the event that the outputs of the rise-time and zero crossover discriminators (Nos. 1 and 2 above) indicate a nuclear detonation signal and the output of the precursor discriminator (No. 3 above) indicates the absence of a lightning signal.

As a preferred feature of the invention, a high-pass frequency filter is inserted in the incoming signal path ahead of the threshold detector.

In the aforesaid precursor discriminator of the invention, means are provided to determine the amplitude ratio of the main lightning signal to the precursor signal and if this ratio exceeds a predetermined value (preferably 50 to one) the signal is considered not to be caused by lightning. Another feature of the invention is the provision of bandpass filters, having different bandpass frequency characteristics, in the paths of the precursor signal and main lightning signal. Preferably, the precursor filter has a bandpass range of five to sixty kilocycles per second, and the main stroke filter has a bandpass range of five to twenty-five kilocycles per second.

DESCRIPTION OF THE PREFERRED EMBODIMENT

Figure 1:
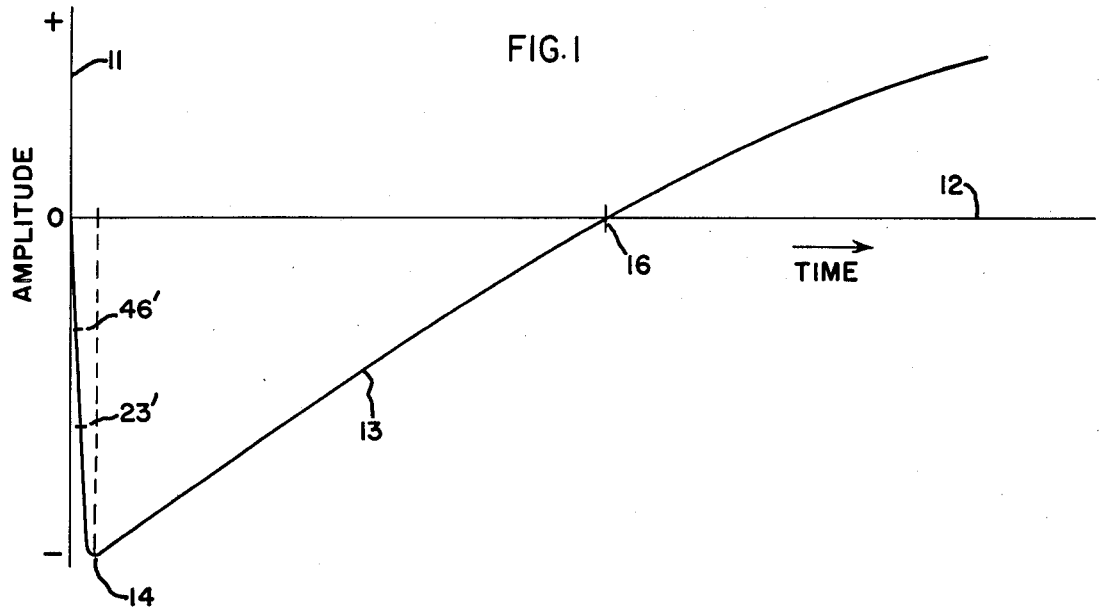
FIG. 1 is a time plot representative of an electromagnetic signal caused by a nuclear detonation. It also is representative of a signal caused by certain lightning strokes.

In FIG. 1, the vertical axis 11 represents signal amplitude and the horizontal axis 12 represents time. A signal 13, negative-going in the example given, which is representative of the electromagnetic signal from a nuclear detonation, and which also is representative of the electromagnetic signal produced by certain lightning strokes, reaches a peak value 14 in less than three microseconds and then crosses the zero axis 12 at a point 16, at a time of about five to fifty microseconds.

Figure 2:
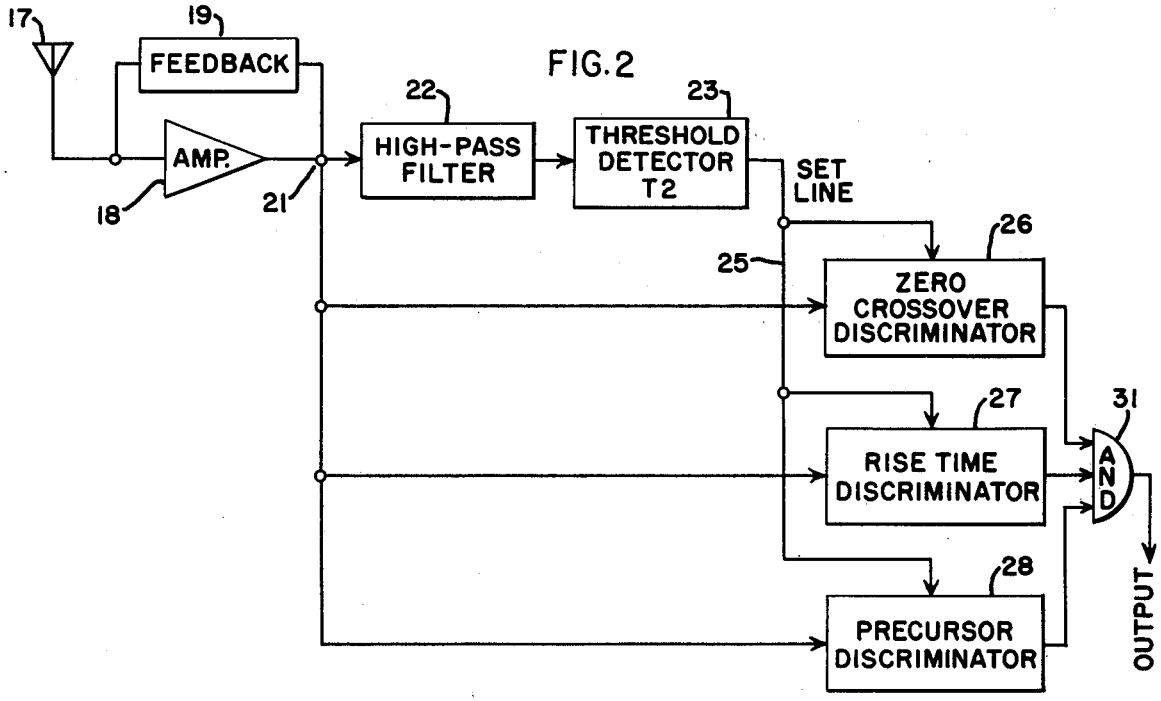
FIG. 2 is an electrical block diagram of a preferred embodiment of the invention.

Now referring to FIG. 2, an antenna 17 picks up the electromagnetic wave 13 as shown in FIG. 1, along with undesired noise and other miscellaneous signals, and applies these received signals to an amplifier 18 provided with feedback 19 which preferably is of a type to provide delayed amplitude compression of signals amplified in amplifier 18 above the threshold level of threshold detector 23—i.e., greater signals will be amplified relatively less, so that the circuits can accommodate a wide dynamic range of input signal strengths. The antenna 17 preferably is a dielectric antenna, i.e., two parallel sheets of conductive material separated by a dielectric. A high pass filter 22, which passes only frequencies greater than 80 kilocycles per second, is connected between the amplifier output terminal 21 and the input of a threshold detector 23 which functions to generate a "set" signal whenever the received signal exceeds a magnitude T2, indicated by the numeral 23' in FIG. 1. The set signal output of the threshold detector 23 is connected via a "set" line 25 so as to enable three circuits: a zero crossover discriminator 26, a rise time discriminator 27, and a precursor discriminator 28. The output terminal 21 of the amplifier 18 is connected to the inputs of the foregoing three discriminator circuits.

The zero crossover discriminator 26 determines whether the signal 13 crosses the zero axis 12 within a required time period, for example between five and fifty microseconds, and if this occurs, it provides an output pulse which is fed to an input of an "AND" gate 31. The rise time discriminator 27 determines whether the signal 13 rises to its peak 14 within a required time, for example within two microseconds, and if this occurs it produces an output signal which is fed to another input of the AND gate 31. The precursor discriminator 28, when enabled, compares the peak value 14 of the incoming signal 13 with the peak amplitude of any signals that have occurred at a certain prior time when a precursor signal would have occurred in the event the signal 13 was caused by lightning. If the precursor discriminator 28 determines that this ratio is such that the signal 13 was not caused by lightning, it provides a signal to a third input of the AND gate 31. Thus, the output signal of the AND gate 31, indicative of a nuclear detonation, occurs only in the event that the zero crossover discriminator 26 and the rise time discriminator 27 each produces simultaneously an output signal indicative of the occurrence of a nuclear detonation, and at the same time the precursor discriminator 28 produces a signal indicating that the detected signal was not caused by lightning. In a preferred system, the output of the AND gate 31 would activate a seismic sensor circuit which functions to determine whether an earth tremor occurs at a proper time after occurrence of the output signal from the AND gate 31, so as to confirm the occurrence of a nuclear detonation.

Figure 3:
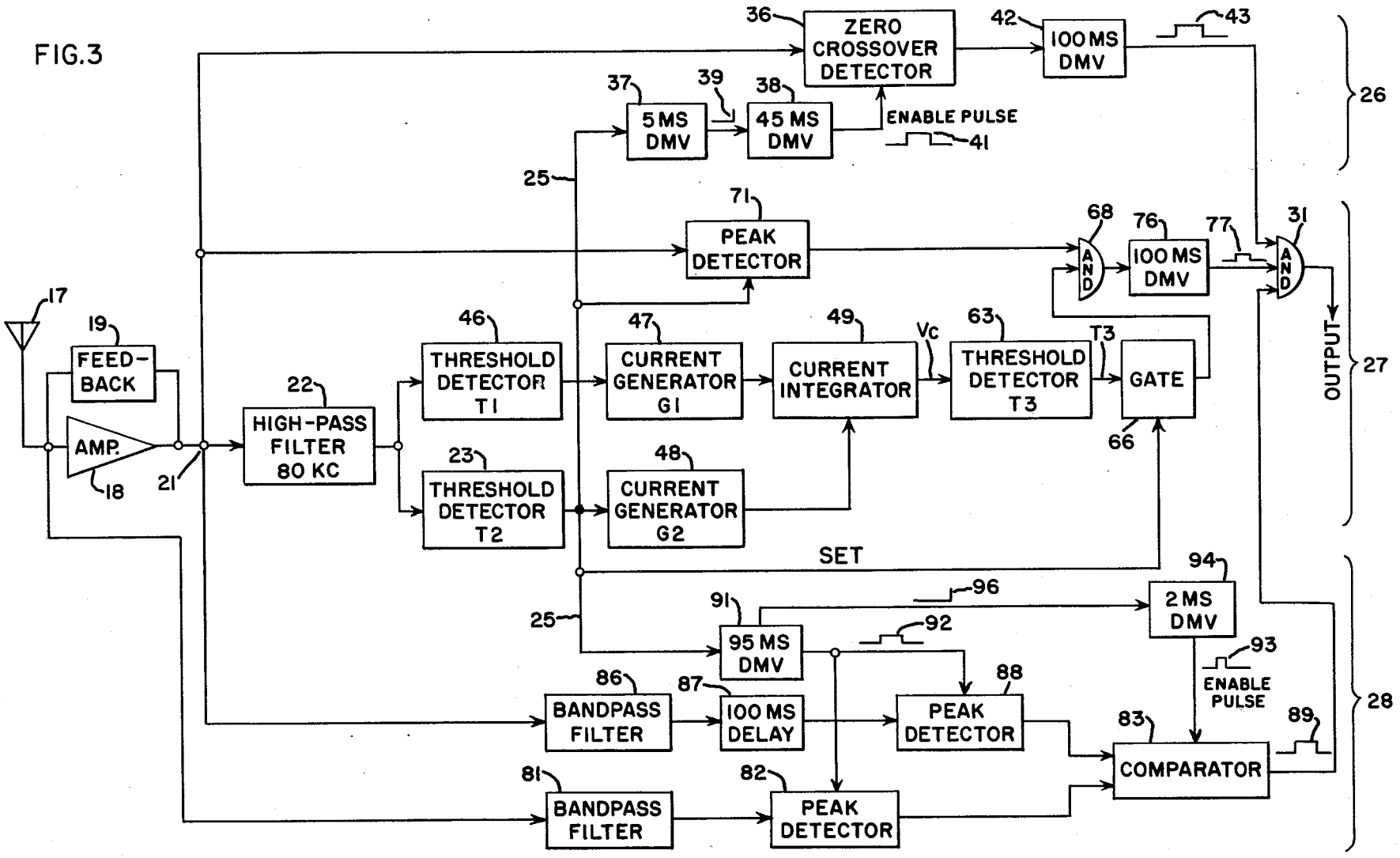
FIG. 3 is a detailed electrical block diagram of the preferred embodiment of the invention.

The more detailed electrical diagram of FIG. 3 discloses further features of the invention. The circuits in FIG. 3 which are the same as shown in the simplified diagram of FIG. 2, are given the same identification numerals as in FIG. 2. For organizational clarity, the detailed circuits in FIG. 3 comprising the zero crossover discriminator 26, the rise time discriminator 27, and the precursor discriminator 28, are located with generally the same arrangement as in FIG. 2, and are indicated by appropriately numbered brackets along the right-hand margin of FIG. 3.

The zero crossover discriminator 26 comprises a zero crossover detector 36 which may comprise, for example, a trigger circuit biased to generate an output pulse when the incoming signal reaches or passes through zero value. The zero crossover detector 36 is enabled by circuitry comprising a five microsecond delayed multivibrator (DMV) 37 connected to the "set" signal output of the threshold detector 23, and followed by a forty-five microsecond delayed multivibrator 38 the output of which is connected to enable the zero crossover detector 36 for forty-five microseconds. Various delayed multivibrator circuits are well known, and are somewhat similar to a "one-shot" multivibrator. When triggered by an input signal, the delayed multivibrator changes its operating state for the particular time period for which it is designed, and then returns to its initial state. Two types of signals may be obtained from a DMV: a timed electrical pulse which has a duration equal to the time period that the DMV is designed to function when triggered, and a short duration pulse at the end of the actuation period, this short pulse occurring when the DMV returns to its quiescent state. For clarity in the drawing, the short duration return-to-quiescent pulse is indicated as shown by numeral 39, where as the numeral 41 indicates the timed output pulse that can be obtained from a delayed multivibrator. The type of output pulse shown in the drawing with a multivibrator, indicates whether the timed pulse or the end-of-operation pulse is utilized from the DMV. Thus, in the zero crossover discriminator 26, the five microsecond DMV 37 functions to initiate the forty-five microsecond DMV 38 at a time of five microseconds after the occurrence of an output "set" signal from the threshold detector 23, whereas the output pulse 41 of the DMV 38 enables the zero crossover detector circuit 36 for a time period of forty-five microseconds commencing five microseconds after the occurrence of an output from threshold detector 23. Thus, the zero crossover detector 36 determines whether the incoming signal 13 (see FIG. 1) crosses the zero axis, as indicated by numeral 16, during a time interval of between five microseconds and fifty microseconds after the T2 threshold point 23'. The output signal of the zero crossover detector 36, which indicates the occurrence of a zero crossover 16 within the predetermined time period, actuates a one hundred microsecond delayed multivibrator 42 which generates a hundred microsecond pulse signal 43 that is applied to an input of the AND gate 31.

The rise time discriminator circuitry 27, which functions to detect whether the peak 14 of the signal 13 occurs within a required time, for example two microseconds after the signal commences, comprises a T1 threshold detector 46 connected to the output of the high-pass filter 22, and arranged so as to generate an output signal when the input signal 13 reaches an amplitude 46' of one-half the amplitude of the T2 amplitude 23'. The T1 threshold detector 46, like the T2 threshold detector 23, may comprise a trigger circuit biased to generate an output signal when the input reaches a certain threshold level. The T1 and T2 threshold detectors 46 and 23 are respectively connected to actuate a G1 current generator 47 and a G2 current generator 48, the outputs of which are connected to a current integrator circuit 49. The current generators G1 and G2 may comprise voltage sources, and resistors connected between these voltage sources and an integrating capacitor in the current integrator 49, so that the capacitor in integrator 49 charges via the resistors from the voltage sources in the current generators 47 and 48. The G1 current generator 47 is designed to charge the capacitor in current integrator 49 at twice the rate as that of generator 48.

Figure 4:
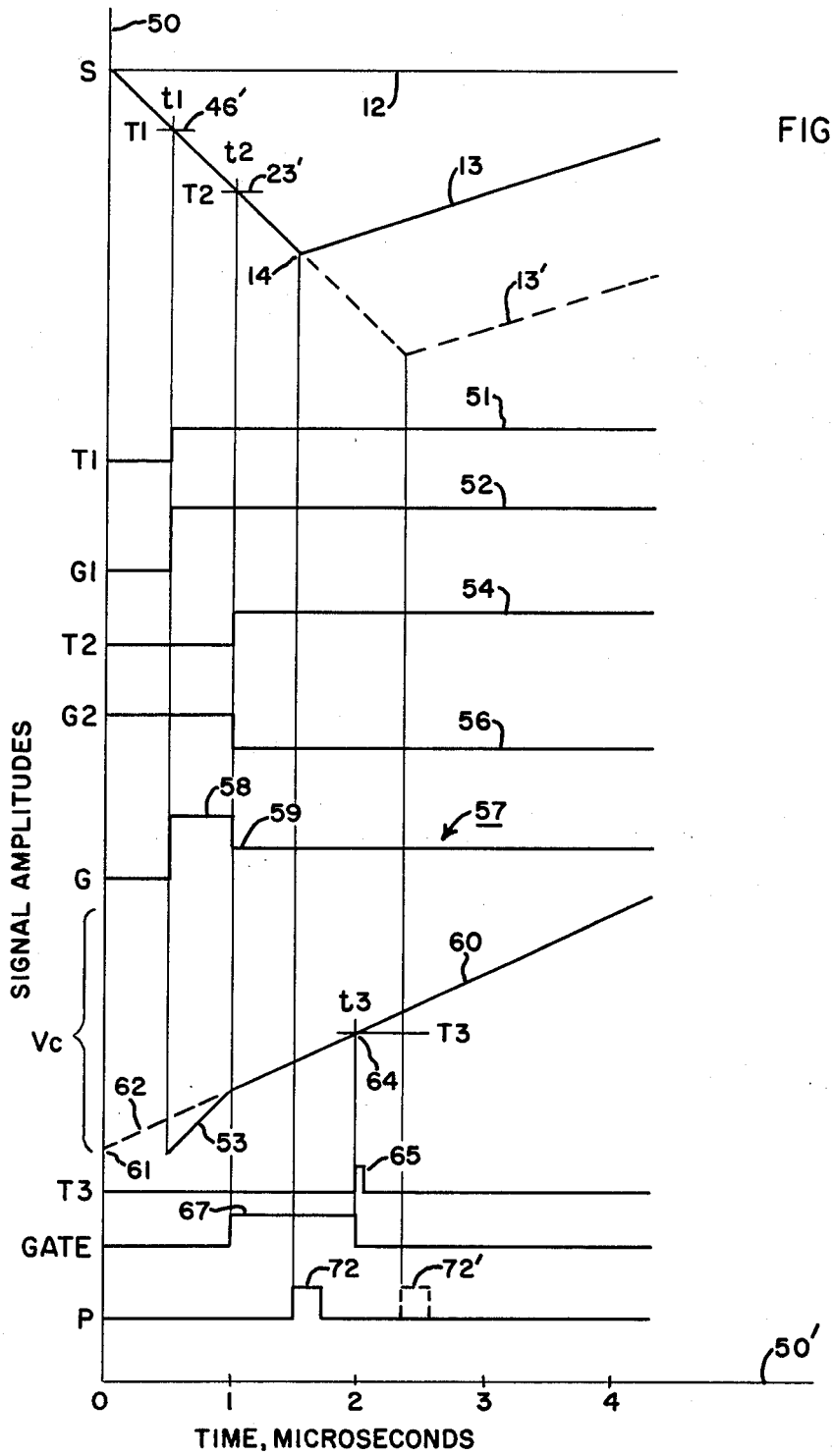
FIG. 4 is a time plot of certain electrical signals which occur in operation of the preferred embodiment of the invention.

The foregoing will now be described with reference to FIG. 4, in which the vertical axis 50 represents amplitudes of various signals and the horizontal axis 50' represents time. The incoming signal 13 is shown in simplified form, rising in a negative direction from zero to the peak 14, then returning toward zero axis 12. When the signal 13 reaches the T1 threshold point 46' at time t1, threshold detector 46 generates the T1 signal 51 beginning at time t1. At the same time t1, current generator 47 generates the G1 current signal 52, thus charging the capacitor in the current integrator 49 along a curve 53 of the capacitor charge voltage curve Vc as shown in FIG. 4. When the incoming signal 13 reaches point 23' at time t2 (t2 is twice the time of t1), threshold detector 23 generates a T2 signal 54 commencing at time t2, causing the current generator 48 to commence generating the G2 current 56, beginning at the time t2. The combined currents G1 and G2 are shown by curve G, indicated by numeral 57. Since current G1 is twice as great as G2, and since G2 is negative with respect to G1, the combined current G rises at the time t1 to a value indicated by numeral 58, and at t2 reduces to a value indicated by numeral 59. Therefore, the Vc capacitor voltage of current integrator 49, after rising as shown by numeral 53 between times t1 and t2, changes to a reduced-slope rate indicated by numeral 60. Since the time t2 is twice as long as time t1, and since the T2 threshold 23' is twice as great as the T1 threshold 46', the curve 60 extrapolates back to time zero and the signal zero point 61, as indicated by the dashed line 62.

Thus, the curve 60 has a slope as though it had commenced at time zero and amplitude zero with respect to the incoming signal 13. Such a curve 60 could not feasibly be obtained directly from the occurrence of signal 13, because the exact commencement time of the signal 13 cannot be detected since it is masked in background noise and other signals. In the circuits shown, the amplitude threshold point T1 (numeral 46') is at an amplitude that is greater than the normal background noise level.

The Vc output signal 53, 60 of the current integrator 49 is applied to a threshold detector 63 having a T3 threshold amplitude as indicated by numeral 64 on the Vc curve 60 in FIG. 4, which corresponds to a time t3 of two microseconds in the example given. Thus, a T3 signal 65 is generated by the threshold detector 63, at a time of two microseconds from the time zero of the incoming signal 13. As has been explained above with reference to the Vc curve 60, this time t3 could not feasibly be obtained directly with respect to time zero of the incoming signal 13, since time zero cannot be directly ascertained due to the existence of background noise accompanying the incoming signal 13.

The T3 signal 65 from the threshold detector 63 is applied to turn off a gate circuit 66, which has been turned on by the T2 signal output 54 of the T2 threshold detector 23, and the gate output signal 67 from the gate 66 is applied to an input of an AND gate 68. The incoming signal 13 is applied to a peak detector 71, which is enabled by the T2 signal 54 applied thereto on the "set" line 25. The peak detector 71 produces an output pulse 72 (see FIG. 4) at the time the peak 14 occurs in the incoming signal 13. A preferable form of peak detector 71 functions by taking the first time derivative of the incoming signal, and produces the output pulse 72 when this first time derivative is zero. Such a circuit may comprise a differentiator and threshold circuit set to produce an output when the signal becomes zero. The threshold circuit would be disabled until enabled by the T2 threshold circuit 23.

The output pulse 72 of the peak detector 71 is applied to another input of the AND gate 68. As is readily seen by comparing the gate signal 67 with the P signal pulse 72 in FIG. 4, if the pulse 72 occurs before the occurrence of the T3 signal 65 (which occurs at t3 equals two microseconds), an output signal will occur from the AND gate 68. However, if the incoming signal 13 has a longer rise time than two microseconds, for instance as shown by the dashed line 13' in FIG. 4, the peak detector output pulse 72' would occur when the gate signal 67 has a value such as not to operate the AND gate 68, and there would not be an output signal from the AND gate 68. The output signal from the AND gate 68, when it occurs, is applied to a 100 microsecond DMV 76, the output of which is applied to another input of the AND gate 31.

The precursor discriminator 28 will now be described, with reference to FIG. 3. The incoming signal from antenna 17 is applied, via a bandpass filter 81, to a first peak detector 82 which functions to detect the occurrence of the peak of a signal such as the main stroke lightning signal. The output signal of the peak detector 82 is fed to a comparator circuit 83. The signal from the amplifier 18 output terminal 21 is applied, via a bandpass filter 86, and through a 100 microsecond delay circuit 87, to a second peak detector 88 which functions to detect the peak amplitude of a precursor signal associated with electromagnetic radiation from lightning and which preceeds the main stroke signal. The output of peak detector 88 is connected to the comparator circuit 83. The bandpass of filter 81 preferably is 5 kilocycles per second to 25 kilocycles per second, and that of filter 86 preferably is 30 kilocycles per second to 100 kilocycles per second. These band-passes, different in the two channels, minimize interference from noise and other signals, and increase reliability of the functioning of these circuits. A ninety-five microsecond DMV 91 is actuated from the set line 25 from T2 threshold detector 23, and generates a ninety-five microsecond pulse 92 which is applied to enable the peak detectors 82 and 88 for a time period of ninety-five microseconds from time t2. The precursor, if there is one, normally will have an amplitude of one-fifth that of the main lightning peak, and will have occurred during a time period of approximately one hundred microseconds prior to the peak of the main signal, hence the use of the one hundred microsecond delay circuit 87, so the output of the precursor peak detector 88 will be approximately coincident in time with that of the main stroke peak detector 82. The comparator 83 is enabled by an enabling pulse 93 produced by a two microsecond DMV 94 which is actuated by the trailing pulse 96 output of the DMV 91.

It is desired that the comparator 83 produce an output pulse 89 only in the absence of a precursor signal which, if it did occur, would be greater than one-fiftieth the amplitude of the peak of the main stroke signal. Therefore, in the preferred embodiment of the invention shown, the precursor signal is amplified by amplifier 18, which has a gain of fifty, and the comparator 83 produces an output signal 89 if the signal to it from the peak detector 82 (which signal can be from lightning or from a nuclear detonation) is greater than that of the precursor peak detector 88. The precursor signal as amplified in amplifier 18 is of relatively low amplitude and, like the threshold amplitude T1 and T2, is below the delayed compression level of the feedback circuit 19 and hence is not compressed in amplitude. The output pulse 89 of the comparator 83, when it occurs, is applied to an input of the AND gate 31. An output signal occurs from the AND gate 31 only in the event that signals 43, 77, and 89 are present at the same time.

The above described preferred embodiment of the invention achieves the objectives of accurately and reliably producing an output signal indicative of the occurrence of a received electromagnetic radiation wave caused by a nuclear detonation, and is practically immune to false responses from electromagnetic signals caused by lightning strokes. This improved-reliability electromagnetic detector contributes to an improved nuclear detonation detection system for warning of an impending danger from nuclear fallout, so that suitable precautions can be timely taken regarding persons, animals, food, medical supplies, etc. so as to enable improved survival from the effects of nuclear fallout.

While a preferred embodiment of the invention has been shown and described, various other embodiments and modifications thereof will be apparent to those skilled in the art, and will fall within the scope of invention as defined in the following claims.

I claim:

1. A sensor for detecting electromagnetic signals from a nuclear detonation, comprising a zero crossover discriminator, a rise time discriminator, and a lightning precursor discriminator; means for intercepting electromagnetic signals and applying a signal representative of same to said discriminators; and means adapted to provide an indication of a nuclear signal whenever said zero crossover discriminator and said rise time discriminator indicate reception of a nuclear detonation electromagnetic signal and said precursor discriminator indicates the absence of a lightning signal, wherein the improvement comprises means for rendering said discriminators normally disabled, a threshold detector adapted to provide an enabling pulse whenever a received signal reaches a predetermined amplitude level, and means for applying said enabling pulse to said discriminators for enabling same.

2. A sensor as claimed in claim 1, including means for applying said received signal to said threshold detector, and a high-pass filter interposed in the path of said received signal ahead of said threshold detector and adapted to pass only frequencies greater than approximately 80 kilocycles per second.

3. A sensor as claimed in claim 1, in which said lightning precursor discriminator comprises a first peak detector, means to apply said received signal to said first peak detector; a second peak detector, an amplifier having a given gain, a time delay means having a time delay equal to the time between a precursor and main stroke of a lightning electromagnetic wave, means for applying said received signal to said second peak detector via said amplifier and said time delay means; and a comparator circuit connected to the outputs of said first and second peak detectors and adapted to provide an output signal when the output of one of said peak detectors is greater than that of the other peak detector, whereby said output signal of the comparator is indicative of the occurrence of a precursor preceding a main lightning stroke by the time period of said time delay and also is indicative of whether the ratio of the amplitude of the main stroke signal to that of the precursor is greater or less than said given gain of the amplifier.

4. A sensor as claimed in claim 3, including a first bandpass filter interposed in the input signal path of said first peak detector and having a frequency band-pass range of approximately five kilocycles per second to twenty-five kilocycles per second, and a second bandpass filter interposed in the input signal path of said second peak detector and having a frequency band-pass range of approximately thirty kilocycles per second to one hundred kilocycles per second.

5. A sensor as claimed in claim 3, including a ninety-five microsecond delayed multivibrator connected to be actuated by said enabling pulse of the threshold detector, means to apply the ninety-five microsecond pulse output of said multivibrator to said first and second peak detectors to enable same; a two microsecond delayed multivibrator connected to be actuated by the end-of-pulse output of said ninety-five microsecond delayed multivibrator, and means to apply the two microsecond pulse output of said two microsecond delayed multivibrator to said comparator circuit for enabling same.

6. A lightning discriminator circuit comprising means for receiving and detecting a lightning stroke by identifying a preceding precursor with a subsequent main stroke, wherein the improvement comprises circuitry including a first peak detector, means to apply the received signal to said first peak detector; a second peak detector, an amplifier having a given gain, a time delay means having a time delay equal to the time between a precursor and main stroke of a lightning electromagnetic radiation wave, means for applying said received signal to said second peak detector via said amplifier and said time delay means; and a comparator circuit connected to the outputs of said first and second peak detectors and adapted to provide an output signal when the output of one of said peak detectors is greater than that of the other peak detector, whereby said output signal of the comparator is indicative of the occurrence of a precursor preceding a main lightning stroke by the time period of said time delay and also is indicative of whether the ratio of the amplitude of the main stroke signal to that of the precursor is greater or less than said given gain of the amplifier.

7. A lightning discriminator as claimed in claim 6, including a first band-pass filter interposed in the input signal path of said first peak detector and having a frequency band-pass range of approximately five kilocycles per second to twenty-five kilocycles per second, and a second band-pass filter interposed in the input signal path of said second peak detector and having a frequency band-pass range of approximately thirty kilocycles per second to one hundred kilocycles per second.

* * * * *